US008159409B2

(12) United States Patent
Harokopus et al.

(10) Patent No.: US 8,159,409 B2
(45) Date of Patent: Apr. 17, 2012

(54) INTEGRATED PATCH ANTENNA

(75) Inventors: William P. Harokopus, McKinney, TX (US); Patrick W. Cunningham, McKinney, TX (US)

(73) Assignee: Raytheon Company, Waltham, MA (US)

( * ) Notice: Subject to any disclaimer, the term of this patent is extended or adjusted under 35 U.S.C. 154(b) by 457 days.

(21) Appl. No.: 12/356,299

(22) Filed: Jan. 20, 2009

(65) Prior Publication Data

US 2010/0182217 A1 Jul. 22, 2010

(51) Int. Cl.
*H01Q 1/38* (2006.01)
*H01Q 1/42* (2006.01)

(52) U.S. Cl. ..... 343/872; 343/700 MS; 343/741; 343/846; 343/851

(58) Field of Classification Search ..... 343/700 MS, 343/756, 767, 770, 872, 895, 909
See application file for complete search history.

(56) References Cited

U.S. PATENT DOCUMENTS

| | | | | |
|---|---|---|---|---|
| 5,233,364 | A | 8/1993 | Lefeuvre et al. | 343/789 |
| 5,465,100 | A * | 11/1995 | Remondiere et al. | 343/769 |
| 5,801,660 | A * | 9/1998 | Ohtsuka et al. | 343/700 MS |
| 5,880,694 | A | 3/1999 | Wang et al. | 343/700 MS |
| 6,061,027 | A | 5/2000 | Legay et al. | 343/700 MS |
| 6,075,485 | A * | 6/2000 | Lilly et al. | 343/700 MS |
| 6,211,824 | B1 * | 4/2001 | Holden et al. | 343/700 MS |
| 6,538,618 | B2 | 3/2003 | Yamamoto et al. | 343/789 |
| 6,567,048 | B2 * | 5/2003 | McKinzie et al. | 343/700 MS |
| 6,624,787 | B2 | 9/2003 | Puzella et al. | 343/700 MS |
| 6,768,471 | B2 * | 7/2004 | Bostwick et al. | 343/853 |
| 6,937,184 | B2 * | 8/2005 | Fujieda et al. | 342/70 |
| 7,712,381 | B2 * | 5/2010 | Allenberg et al. | 73/861.08 |
| 2003/0122712 | A1 | 7/2003 | Rawnick et al. | |
| 2004/0036148 | A1 | 2/2004 | Block et al. | 257/621 |

FOREIGN PATENT DOCUMENTS

| | | |
|---|---|---|
| EP | 0720252 | 7/1996 |
| WO | WO 96/39728 | 12/1996 |
| WO | WO 2007/055028 | 5/2007 |

OTHER PUBLICATIONS

Notification of Transmittal of the International Search Report and the Written Opinion of the International Searching Authority, or the Declaration; PCT/US2009/069206; dated Mar. 15, 2010; 13 pages.
J.R. James et al. "Handbook of Microstrip Antennas", vol. ', pp. 592-597; dated Dec. 31, 1989.

(Continued)

*Primary Examiner* — Douglas W Owens
*Assistant Examiner* — Chuc Tran
(74) *Attorney, Agent, or Firm* — Daly, Crowley, Mofford & Durkee, LLP

(57) ABSTRACT

According to one embodiment, an integrated patch antenna may comprise a radome layer, having an outside surface and an inside surface, and a radiating layer. The radiating layer has a top surface and a bottom surface, the top surface of the radiating layer conforming to the shape of the inside surface of the radome layer. The radiating layer comprises a dielectric layer, a radiating element formed on a first side of the dielectric layer, and a moat formed in the dielectric layer around its perimeter forming an inner perimeter sidewall and an outer perimeter sidewall. The radiating layer also comprises a conductive coating disposed on the inner perimeter sidewall or the outer perimeter sidewall and a feed line disposed on a second side of the dielectric substrate.

13 Claims, 2 Drawing Sheets

OTHER PUBLICATIONS

P. Bhartia, et al. "Millimeter-Wave Microstrip and Printed Circuit Antennas" pp. 295-300; dated Dec. 31, 1991.
Guha, D., et al. "Resonant Frequency of Circular Microstrip Antenna Covered with Dielectric Superstrate", vol. 51, No. 7, pp. 1649-1652; dated Jul. 1, 2003.
Hassani, et al., "Analysis of Triangular Patch Antennas Including Radome Effects"; IEEE Proceedings H. Microwave, Antennas and Propagation, Institution of Electrical Engineers, vol. 139, No. 3 Part H, pp. 251-256; dated Jun. 1, 1992.
U.S. Appl. No. 12/249,430 entitled "Patch Antenna", filed Oct. 10, 2008.
Notification of Transmittal of the International Search Report and the Written Opinion of the International Searching Authority, or the Declaration; for PCT/US2008/079555; (13 pgs), Apr. 3, 2009.
*Response Pursuant to 37 C.F.R. § 1.111*; U.S. Appl. No. 12/249,430; in the name of Harokopus, (9 pgs), date filed Sep. 23, 2011.
*USPTO Office Action*; U.S. Appl. No. 12/249,430; in the name of Harokopus, (10 pgs), Notification Date Jun. 24, 2011.

* cited by examiner

INTEGRATED PATCH ANTENNA

TECHNICAL FIELD OF THE DISCLOSURE

This disclosure generally relates to patch antennas, and more particularly, to a conformal antenna and radome apparatus.

BACKGROUND OF THE DISCLOSURE

A patch antenna is a popular antenna type, comprising a metal patch suspended over a ground plane. The assembly is usually contained in a distinct plastic radome, which protects the structure from damage. Patch antennas are simple to fabricate and easy to modify and customize. Typically, patch antennas may also include microstrip antennas, which are constructed on a dielectric substrate and may employ the same type of lithographic patterning used to fabricate circuit boards.

SUMMARY OF THE DISCLOSURE

This disclosure generally relates to patch antennas, and more particularly, to an integrated patch antenna.

According to one embodiment, an integrated patch antenna may comprise a radome layer having an outside surface and an inside surface, and a radiating layer. The radiating layer has a top surface and a bottom surface, the top surface of the radiating layer conforming to the shape of the inside surface of the radome layer. The radiating layer comprises a dielectric layer, a radiating element formed on a first side of the dielectric layer, and a moat formed in the dielectric layer around its perimeter forming an inner perimeter sidewall and an outer perimeter sidewall. The radiating layer also comprises a conductive coating disposed on the inner perimeter sidewall or the outer perimeter sidewall and a feed line disposed on a second side of the dielectric substrate.

Some embodiments may provide numerous technical advantages. Some embodiments may benefit from some, none, or all of these advantages. For example, a technical advantage of one embodiment may include the capability to provide an integrated antenna and radome for conformal installations. Other technical advantages of other embodiments may include the capability to provide a protective radome integrated with the patch antenna that has minimal or no impact on the performance of the antenna. Yet other technical advantages of some embodiments may include the capability to provide a integrated patch antenna that may conform to contoured surfaces without sacrificing antenna performance. Yet other technical advantages of some embodiments may include the capability to produce a low-cost integrated patch antenna using commercially-available materials.

Although specific advantages have been enumerated above, various embodiments may include all, some, or none of the enumerated advantages. Additionally, other technical advantages may become readily apparent to one of ordinary skill in the art after review of the following figures and description.

BRIEF DESCRIPTION OF THE DRAWINGS

For a more complete understanding of embodiments of the disclosure and its advantages, reference is now made to the following detailed description, taken in conjunction with the accompanying drawings, in which.

DETAILED DESCRIPTION OF EXAMPLE EMBODIMENTS

It should be understood at the outset that, although example implementations of embodiments are illustrated below, the present invention may be implemented using any number of techniques, whether currently known or not. The present invention should in no way be limited to the example implementations, drawings, and techniques illustrated below. Additionally, the drawings are not necessarily drawn to scale.

A patch antenna generally comprises a metal patch suspended over a ground plane. A patch antenna is often paired with a radome. A radome is a weatherproof enclosure that protects an antenna.

One example of a patch antenna is formed using lithographic patterning techniques, as described in U.S. patent application Ser. No. 12/249,430, entitled PATCH ANTENNA, filed Oct. 10, 2008. U.S. patent application Ser. No. 12/249,430 is hereby incorporated by reference. However, embodiments are not limited to patch antennas formed using lithographic patterning techniques, but may include patch antennas formed by various manufacturing techniques. Furthermore, some embodiments may also include arrays of multiple patch antennas.

Patch antennas and radomes are often designed and manufactured independently. However, independent patch antennas and radomes may increase costs in conformal installations because both the patch antenna and radome must independently fit the conformal installation. Furthermore, patch antennas may be manufactured from materials that are not compatable with the environment and that are not easily integrated with a separate radome. In addition, in some embodiments, the performance of the antenna may be better than a design using a distinctly manufactured radome. Thus, teachings of certain embodiments recognize the use of an integrated patch antenna and radome assembly. Teachings of certain embodiments recognize an integrated patch antenna and radome assembly may reduce costs in conformal installations.

Figure 1A:
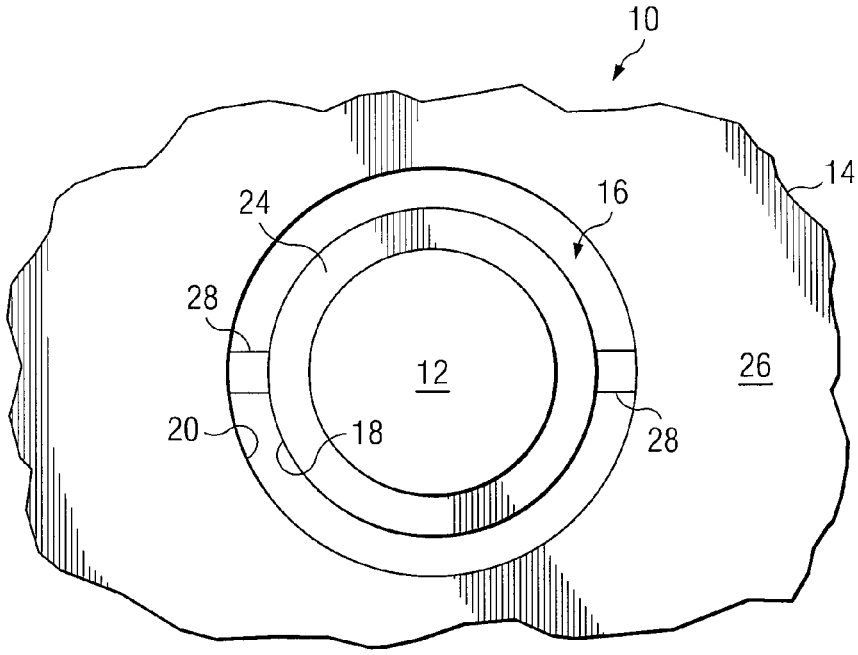
FIG. 1A is a plan view of one embodiment of a radiating layer that may be used to form a patch antenna according one embodiment.
Figure 1B:
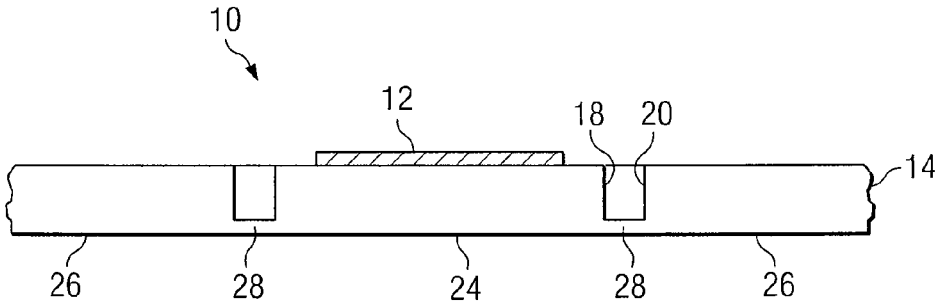
FIG. 1B is a cross-sectional, side elevational view of the radiating layer of FIG. 1A.

FIGS. 1A and 1B illustrate an example patch antenna radiating layer 10 according to one embodiment. FIG. 1A presents a plan view, and FIG. 1B presents a cross-sectional, side elevational view. Radiating layer 10 features at least one radiating element 12 formed on a dielectric substrate 14. A moat 16 extends around the perimeter of the radiating element 12 to form an inner perimeter sidewall 18 and an outer perimeter sidewall 20, separating an inner substrate portion 24 from an outer substrate portion 26.

Dielectric substrate 14 may be formed of any suitable insulative material. In some embodiments, dielectric substrate 14 may be comprised of a composite laminates or of a printed circuit board material. In one embodiment, dielectric substrate 14 may be made of a flame resistant 4 (FR4) material. The dielectric substrate 14 may be initially provided with a coating of copper or other conductive material on one or both of its sides.

Radiating layer 10 may include one or more tabs 28 that maintain inner substrate portion 24 in a fixed physical relationship to outer substrate portion 26. Tabs 28 may be formed during creation of moat 16, in which a relatively small portion of dielectric material remains following the routing process. Thus, radiating element 12 may be formed using a common etching and routing process on a dielectric substrate 14 while the moats 16 provide relatively improved isolation from other radiating elements disposed nearby.

Patch antennas such as the embodiment illustrated in FIGS. 1A and 1B may provide certain advantages over other patch antennas. For example, a patch antenna with cavities such as moat 16 may be more flexible than alternative patch antennas, lending itself to conformal installations. In addition, the size, shape, and relative placement of the radiating element 12 on the dielectric substrate 14 may be maintained within relatively tight specifications.

FIGS. 1A and 1B illustrate an embodiment featuring radiating elements 12 with a circular shape; however, other embodiments of radiating elements 12 may have any suitable geometrical shape, including a square shape, an octagonal shape, and a rectangular shape.

Figure 2:
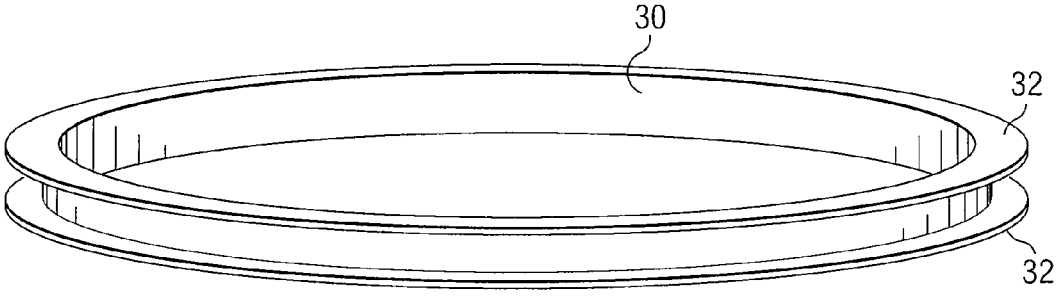
FIG. 2 is a perspective view of a conductive coating that may be used with the radiating layer of FIGS. 1A and 1B.

In some embodiments, inner perimeter sidewall 18 and outer perimeter sidewall 20 may be plated with a conductive coating made of a conductive material, such as metal. The conductive coating forms an isolation barrier of radiating element 12 from other radiating elements formed on dielectric substrate 14. FIG. 2 illustrates one example embodiment of a conductive coating 30 of the radiating layer 10 with the dielectric substrate 14, radiating element 12, and tabs 28 removed. In this particular embodiment, conductive coating includes metalized rings 32 on both sides of the dielectric substrate 14. In one embodiment, these metalized rings 32 may provide electromagnetic interference (EMI) isolation to other metalized rings 32 on additional radiating layers 10.

Figure 3:
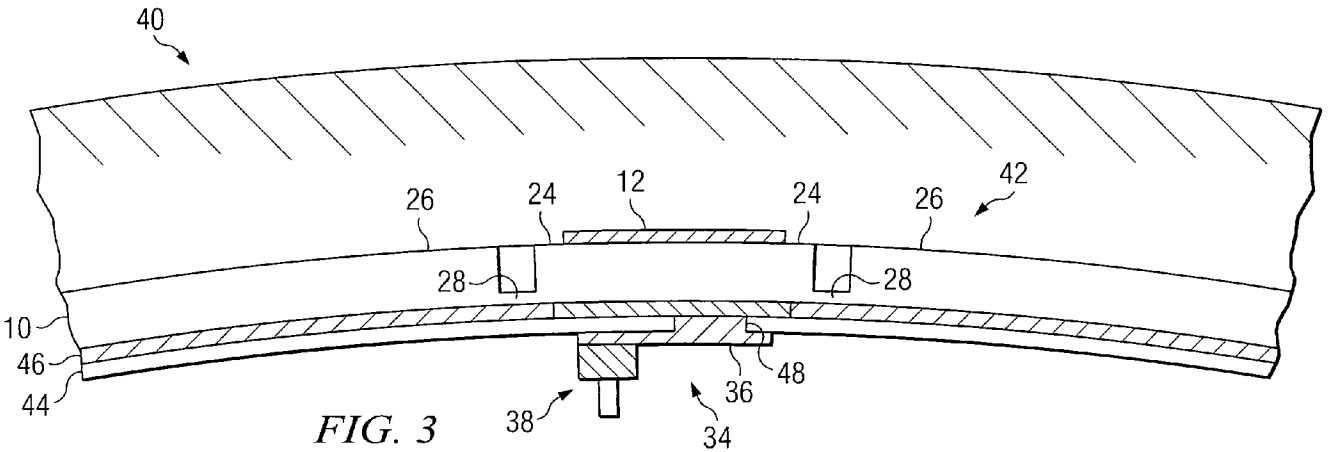
FIG. 3 presents an integrated patch antenna, according to several embodiments.

FIG. 3 presents an integrated patch antenna 40 according to several embodiments. Integrated patch antenna 40 features a radiating layer 10 with one or more radiating elements 12, inner substrate portions 24, outer substrate portions 26, and tabs 28. However, embodiments of integrated patch antenna 40 are not limited to the particular radiating layer 10 illustrated in FIG. 3, but may include any type of radiating layer.

Integrated patch antenna 40 also features a radome 42. Radome 42 may include any structure capable of protecting radiating element 10. In some embodiments, radome 42 may comprise material that minimally attenuates the electromagnetic signal transmitted by the antenna. In other embodiments, the radome may be transparent to radar or radio waves. In some embodiments, radome 42 may be comprised of a laminate composite material. One example embodiment of radome 42 may be comprised of quartz or glass pre-impregnated fabric. Radome 42 may also be formed into any shape or size. For example, radome 42 may conform to the shape of a larger component, such as the curvature of the fuselage of an aircraft. In such an embodiment, radiating layer 10 may conform to the shape of the radome 42.

Integrated patch antenna may also feature a connector 34 comprising a microstrip feed line 36 coupled to a surface mount connector 38 disposed on a side of radiating layer 10. Surface mount connector 38 may be any suitable type of connector, such as an SubMiniature version B (SMB) connector, for coupling integrated patch antenna 40 to a receiver or transmitter. In the particular embodiment shown, radiating elements 12 are driven by a microstrip feed line 36; however, radiating elements may be driven by any type feed line that electrically couples radiating elements 12 to a transmitter or receiver.

Integrated patch antenna 40 may also feature a relatively thin dielectric layer 44 on which microstrip feed line 36 may be formed. In the particular embodiment shown, dielectric layer 44 is approximately 10 mils (10 micro-inches) in thickness and each of the two radiating layers 10 are approximately 100 mils (100 micro-inches) in thickness. Other embodiments, however, may incorporate dielectric layers 44 and/or radiating layers 10 having other thicknesses to tailor the performance parameters of patch antenna 40.

A ground plane 46 may be provided on dielectric layer 44 opposite microstrip feed line 36. A hole 48 may be formed in ground plane 46 through which an electric field may be formed on radiating elements 12 when microstrip feed line 36 is excited with an electrical signal. The hole 48 may be generally aligned with the radiating element 12 such that electric fields generated by microstrip feed line 36 and ground plane 46 are converted to electro-magnetic energy by radiating element 12.

Figure 4B:
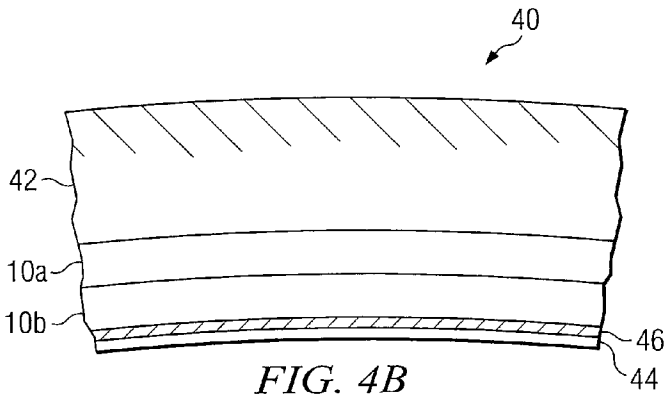
FIGS. 4A and 4B present two example configurations of an integrated patch antenna, according to several embodiments.
Figure 4A:
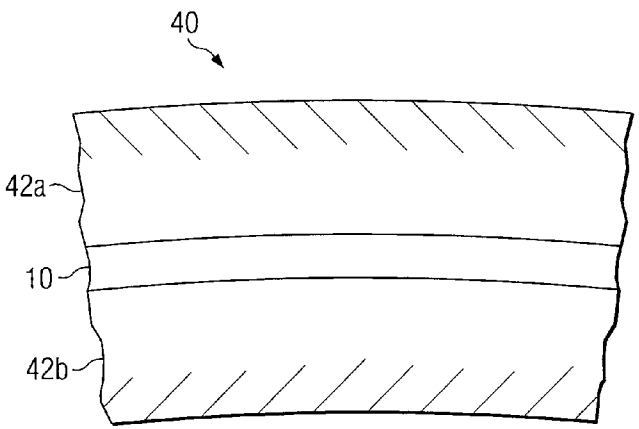

The embodiment illustrated in FIG. 3 features a single radome layer 42 and a single radiating layer 10. However, other embodiments may include additional radome layers 42 and radiating layers 10 arranged in any configuration. FIGS. 4A and 4B feature two example configurations of integrated patch antenna 40 according to several embodiments. FIG. 4A features a patch antenna 40 with a radiating layer 10 sandwiched between two radome layers 42*a* and 42*b*. In embodiments such as the embodiment illustrated in FIG. 4A, the dielectric substrate 14 and the surface mount connector 38 may be mounted on the inside of layer 42*b*. In some embodiments, layer 42*b* may be optimized in thickness to add mechanical strength to the radome. FIG. 4B features a patch antenna 40 with a single radome layer 42 and two radiating layers 10*a* and 10*b*, each radiating layer including a radiating element 12 (not illustrated). FIG. 4B also features a dielectric layer 44 and a ground plane 46.

Although the present disclosure has been described with several embodiments, a myriad of changes, variations, alterations, transformations, and modifications may be suggested to one skilled in the art, and it is intended that the present disclosure encompass such changes, variations, alterations, transformation, and modifications as they fall within the scope of the appended claims.

To aid the Patent Office, and any readers of any patent issued on this application in interpreting the claims appended hereto, applicants wish to note that they do not intend any of the appended claims to invoke 6 of 35 U.S.C. §112 as it exists on the date of filing hereof unless the words "means for" or "step for" are explicitly used in the particular claim.

What is claimed is:

1. An integrated patch antenna comprising:

a radome layer, the radome layer having a curved outside surface and a curved inside surface; and a radiating layer formed integral with the radome layer, the radiating layer having a curved top surface and a curved bottom surface, the curved top surface of the radiating layer conforming to the shape of the curved inside surface of the radome layer, wherein the radiating layer comprises:

a dielectric layer;

a radiating element formed on a first side of the dielectric layer;

a moat formed in the dielectric layer around its perimeter forming an inner perimeter sidewall and an outer perimeter sidewall;

a conductive coating disposed on the inner perimeter sidewall or the outer perimeter sidewall; and a feed line disposed on a second side of the dielectric layer.

2. The integrated patch antenna of claim 1, wherein the radome layer is comprised of a structural composite laminate.

3. The integrated patch antenna of claim 1, wherein the radome layer is comprised of a flexible composite laminate.

4. The integrated patch antenna of claim 1, wherein the radome layer is comprised of a quartz prepreg fabric.

5. The patch antenna of claim 1, further comprising a second radiating layer, the second radiating layer conforming to the bottom side of the first radiating layer such that the at least one radiating element of the second radiating layer is aligned with the at least one radiating element of the first radiating element.

6. The patch antenna of claim 1, further comprising a second radome layer, the second radome layer conforming to the bottom side of the radiating layer.

7. The integrated patch antenna of claim 1, wherein the radiating layer comprises one or more cavities cut into the radiating layer.

8. The integrated patch antenna of claim 1, wherein the dielectric layer is comprised of a composite laminate.

9. The integrated patch antenna of claim 1, wherein the dielectric layer is comprised of a printed circuit board material.

10. The integrated patch antenna of claim 1, wherein the radiating layer further comprises a plurality of tabs extending between the inner perimeter sidewall and the outer perimeter sidewall, the plurality of tabs operable to maintain an inner substrate portion is a fixed physical relation to an outer substrate portion, the moat forming the inner substrate portion and the outer substrate portion.

11. The integrated patch antenna of claim 1, wherein the radiating layer further comprises a ground plane disposed on the second side of the dielectric substrate and electrically isolated from microstrip feed line, the ground plane having a hole between the at least one radiating element and the microstrip feed line.

12. The integrated patch antenna of claim 11, wherein the radiating layer further comprises a surface mount connector attached to the second side and electrically coupled to the feed line.

13. The patch antenna of claim 1, wherein the feed line comprises a microstrip feed line.

* * * * *